US005356224A

United States Patent [19]

Durchschlag

[11] Patent Number: 5,356,224

[45] Date of Patent: Oct. 18, 1994

[54] DEVICE FOR FASTENING SLIDE INSERTS

[75] Inventor: Gerald Durchschlag, Zeltweg, Austria

[73] Assignee: Voest-Alpine Eisenbahnsysteme Aktiesengesselschaft, Vienna, Austria

[21] Appl. No.: 59,594

[22] Filed: May 12, 1993

[30] Foreign Application Priority Data

May 18, 1992 [AT] Austria ..... 1019/92

[51] Int. Cl.[5] ..... E01B 7/26; F16C 33/02

[52] U.S. Cl. ..... 384/41; 246/453; 384/42

[58] Field of Search ..... 246/453, 430; 384/13, 384/26, 41, 42

[56] References Cited

U.S. PATENT DOCUMENTS

| | | | |
|---|---|---|---|
| 1,683,745 | 9/1928 | Watson | 384/41 |
| 2,630,353 | 3/1953 | Rutz | 384/4 |
| 3,053,580 | 9/1962 | Bullard, III et al. | 384/41 |
| 4,105,175 | 8/1978 | De Spiegeleer | 246/453 X |
| 4,738,081 | 4/1988 | Tisma | 384/42 |
| 5,125,603 | 6/1992 | Orasche et al. | 246/453 |
| 5,127,613 | 7/1992 | Germann | 246/453 |

FOREIGN PATENT DOCUMENTS 232726 8/1987 European Pat. Off. ..... 246/453

*Primary Examiner*—Thomas R. Hannon
*Attorney, Agent, or Firm*—Cushman, Darby & Cushman

[57] ABSTRACT

In the case of a device for fastening of at least one exchangeable elongate slide insert (5), in particular synthetic plastics material slide inserts, in recesses of a slide base or ribbed plate (4), in which the side surfaces of the slide insert (5) are at least partly gripped by inwardly-sloping or undercut walls of the recesses, the slide inserts (5), on their underside and transversely to their longitudinal axis, have a straight-line groove, in which case the slide base or ribbed plate (4) on its upper side has a groove open towards the top in alignment with the groove in the insert, and the groove in the slide base or ribbed plate (4) and the groove in the slide insert (5), in the locking-in position, define a clear opening for the insertion of a rod-shaped locking-in member (7), the free ends of which project, in a plastically deformable mariner, beyond the edges of the slide base or ribbed plate.

6 Claims, 3 Drawing Sheets

Figure 1:
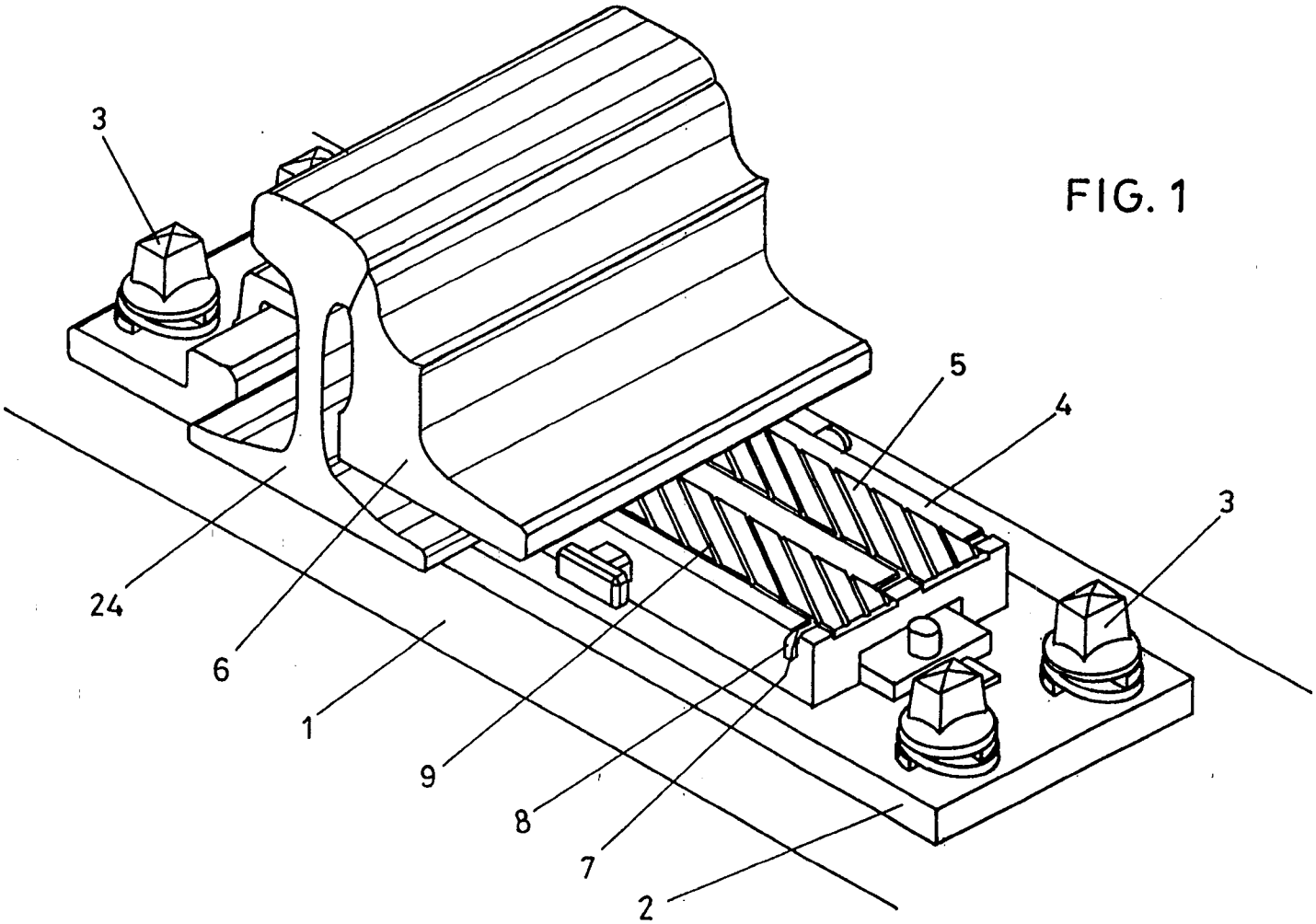

FIG. 3
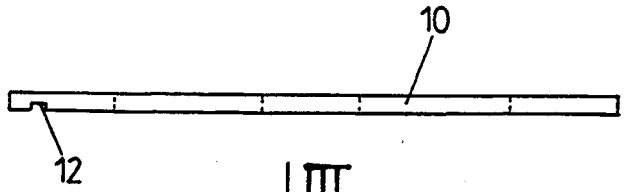
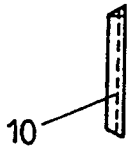
FIG. 4
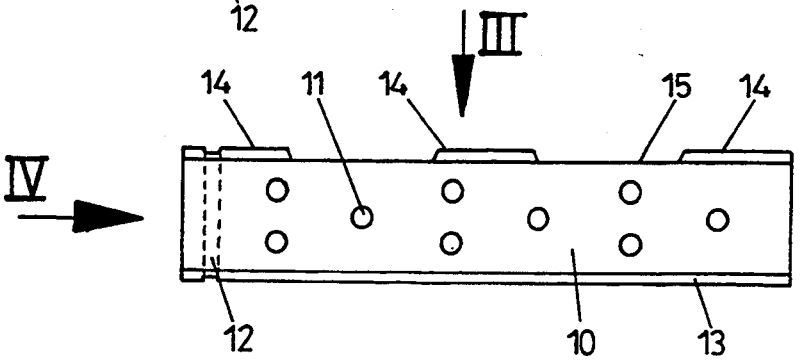
FIG. 2
FIG. 6
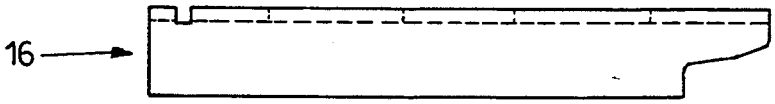
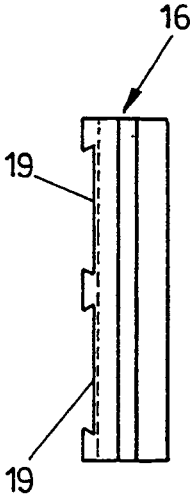
FIG. 7
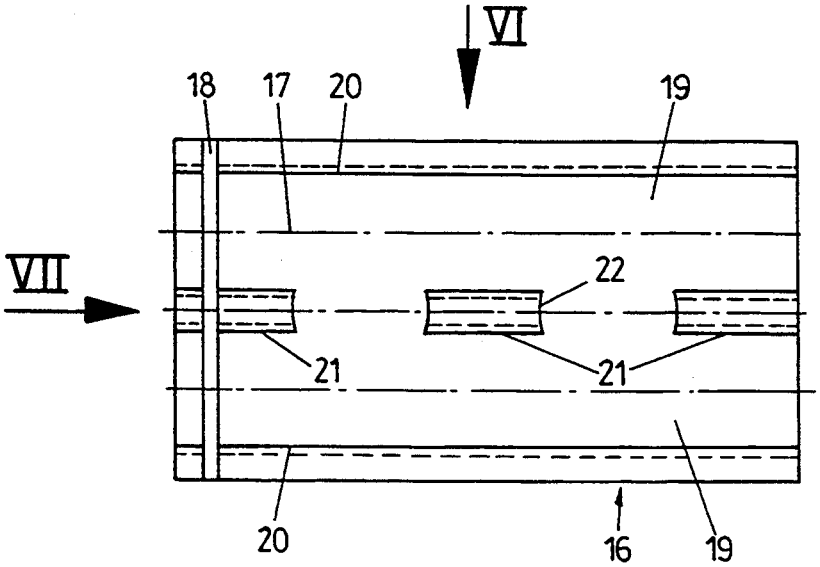
FIG. 5

DEVICE FOR FASTENING SLIDE INSERTS

The present invention relates to a device for fastening of at least one exchangeable elongate slide insert, in particular a synthetic plastics material sliding insert, in one or more recesses of a slide base or ribbed plate, in which the side surfaces of the slide insert are at least partly gripped by inwardly-sloping or undercut walls of the or each recess.

Slide inserts of the type referred to initially are described, for example, in U.S. Pat. No. 5,125,603, dated Jun. 30, 1992 . In the case of this known configuration, elongate slide elements made from synthetic plastics material were arranged in a slide base in such a manner that, first of all, a portion was driven into a recess in the slide base and brought into a position in which at least a greater part of the side walls of the slide components were gripped by inwardly-sloping or undercut walls. In the practical embodiment, this type of slide insert had a substantially trapezoidal cross-section and was inserted or driven into a dovetail groove, in which case the height of the slide insert was naturally greater than the depth of the dovetail groove, so that the slide insert provided support on its upper surface for the sliding raft components, for example the switch rail or a pivotable frog. For insertion of the elongate slide inserts into this type of recess, which has inwardly-sloping side walls, at least a portion thereof must be fabricated with a width that exceeds the maximum width of the slide components to make possible the insertion or driving in of said slide components. The definitive locking-in is effected by the insertion of a second such slide component, in which the joint between adjacent regions of the slide components comes to lie in this enlarged recess for the insertion of the slide components. The disadvantage of such a configuration is the divided configuration of the slide components and the situation that the locking-in of the components depends to a very large extent on the fact that the base of the groove must be free of excessive contamination because, if such is not the case, a satisfactory locking into position cannot be achieved without difficulty.

The object of the invention is the creation of a device of the type referred to initially by means of which it is possible to achieve, in a particularly simple manner, the locking-in of slide components in a substantially elongate form into a slide base or a ribbed plate, and in which the divided configuration of the slide components may be avoided. In particular, the inventive configuration is intended to serve the purpose of making possible the secure locking-in of the slide components of a design where only a limited number of special parts or slide inserts are required for each slide base or ribbed plate. In order to achieve this objective, the inventive configuration is characterised in that the slide inserts, on their underside and transversely of their longitudinal axis, have a straight-line groove, and in that the slide base or ribbed plate on its upper side has a groove open towards the top in alignment with the groove in the insert, and in that the groove in the slide base or ribbed plate and the groove in the slide insert, in the locking-in position, define a clear opening for the insertion of a rod-shaped locking-in member, the free ends of which project, in a plastically deformable manner, beyond the edges of the slide base or ribbed plate. On the other hand, because elongate slide inserts may be utilised which are simply inserted into an appropriate groove, especially a groove with a dovetail profile in the slide base or ribbed plate, it is possible that a lesser number of this type of slide insert will be sufficient, because of the fact that the slide inserts have a groove open towards the bottom, and that the ribbed plates or slide bases have a corresponding groove which, in the locking-in position, is in alignment with the groove in the slide insert, in each case, in the un-assembled condition, an open groove is provided which can easily be kept free from contamination and which, after pushing-in of the slide inserts, directly provides an appropriate channel or appropriate aperture for accommodation of a locking-in member in the form of a rod. This type of rod-shaped locking-in member may subsequently be simply secured in position by bending its ends around the edges of the slide base or ribbed plate by striking the ends with a hammer. The result is a very simple rigid assembly, using cheap steel profiles for the locking-in members.

It is advantageous for the design to be such that the locking-in member is formed from a flat bar with a rectangular cross-section. This type of rectangular profile allows for the bending or hammering around of the free ends of the locking-in member over the shorter side of the rectangle with only a small expenditure of effort.

It is advantageous for the design to be such that the length of the longer axis of the slide inserts is substantially equal to the length of the slide base or of the ribbed plate in the direction of displacement of the sliding parts, by means of which it is possible that a lesser number of slide inserts will be found to be sufficient for each slide base or ribbed plate. At the same time, with this type of configuration the advantage is derived that, with the same locking-in member, a plurality of slide inserts may be securely locking into position, for which purpose it is an advantage for the design to be such that at least two slide inserts arranged parallel to one another may be fastened into one slide base or ribbed plate with the use of one locking-in member in common.

In order to ensure the sliding properties during operation over longer periods of time, even if there is severe contamination, and in order to reduce the wear-and-tear on the slide inserts, it is an advantage for the design to be such that the slide inserts are provided, on their slide surfaces facing towards the sliding components, with grooves extending at an acute angle to the longer axis of the slide surface.

Figure 9:
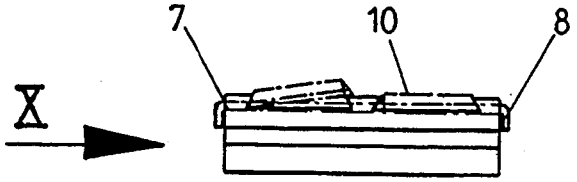
Figure 8:
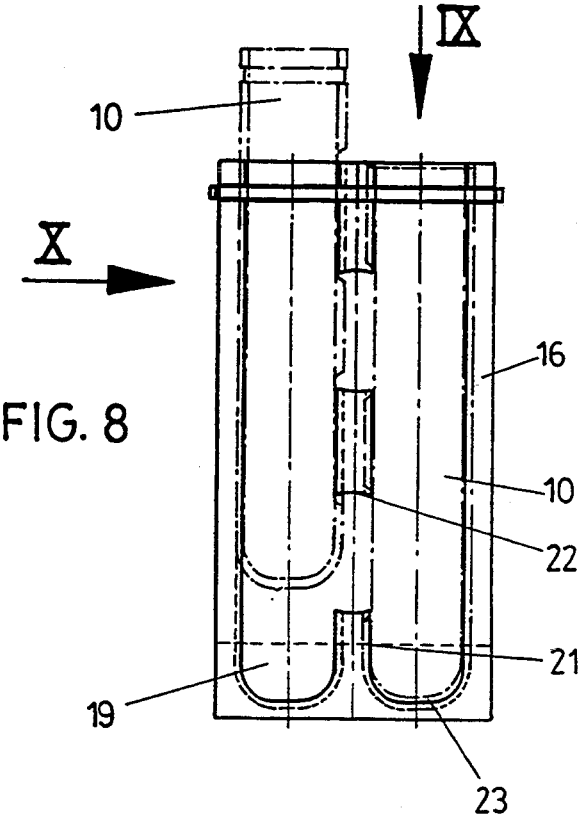
Figure 10:
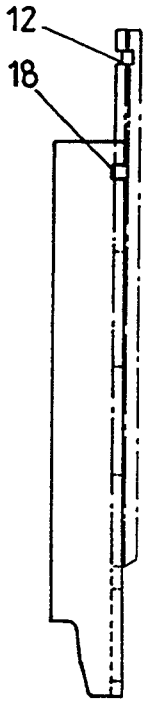
Figure 11:
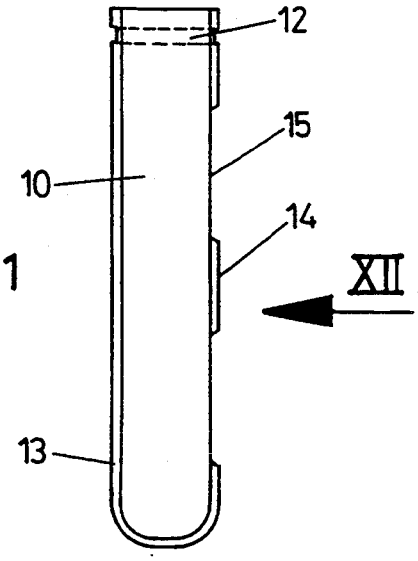
Figure 12:
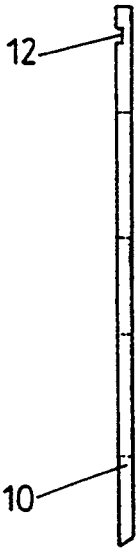

The invention will now be described in greater detail in relation to examples of embodiment depicted diagrammatically in the drawings, in which:

FIG. 1 is a perspective view of a first embodiment of the inventive device, additionally depicting portions of the sole plate or fibbed plate and also of the rails affixed thereto or arranged to slide upon them, FIG. 2 is a plan view of a modified embodiment of an inventive slide insert, FIG. 3 is a side elevation viewed in the direction of arrow III in FIG. 2, FIG. 4 is an end elevation viewed in the direction of arrow IV in FIG. 2, FIG. 5 is a plan view of a slide base or fibbed plate for use in conjunction with the embodiment of a slide insert in accordance with FIG. 2, FIG. 6 is a side elevation viewed in the direction of arrow VI in FIG. 5, FIG. 7 is an end elevation viewed in the direction of arrow VII in FIG. 5, FIG. 8 is a plan view of a modified embodiment of a slide base or ribbed plate with partly inserted slide inserts, FIG. 9 is an end elevation viewed in the direction of arrow IX in FIG. 8, FIG. 10 is a side elevation viewed in the direction of arrows X in FIG. 8 and 9, FIG. 11 is a plan view of a slide insert for use in conjunction with the embodiment in accordance with FIG. 8, and FIG. 12 is a side elevation viewed in the direction of arrow XII in FIG. 11.

In the embodiment depicted in FIG. 1, a ribbed plate 2 is affixed to a sole plate 1 by means of screw-threaded fasteners 3, in which case a stationary raft 24 is affixed to the ribbed plate 2 in a known manner not depicted in greater detail. In addition, a slide base 4 is provided on the ribbed plate 2, in which case the slide base 4 is furnished with slide inserts 5 which, in the embodiment depicted, are made from synthetic plastics material to support a movable rail 6 so that it is able to slide over them. The synthetic plastics material slide inserts 5 have an elongate shape and can be pushed into corresponding recesses in the slide base 4, in which case the side surfaces of the slide inserts are at least partly gripped by inwardly-sloping or undercut walls of the recesses in the slide base, as will be shown more dearly in the subsequent embodiments. On the underside of the slide insert 5, transversely to its longitudinal axis, there is a straight-line groove, in which case there is a corresponding groove in the upper surface of the slide base which comes into alignment with the groove in the insert when it is in the locking-in position. A rod-shaped locking-in member 7 may be inserted into the aligned grooves to serve for locking the pushed-in slide inserts securely in position.

The locking-in member 7 is, by way of example, formed from a flat bar with a rectangular cross-section. The free ends 8 of the rod-shaped locking-in member 7 are plastically deformable around the edges of the slide base 4, in which case, by way of example, after successful insertion of the slide inserts 5 and insertion of the member 7 through the grooves formed in the surfaces of the inserts and the slide base, the free ends 8 may be bent around, for example, by striking with a hammer.

In the fabrication of the slide inserts 5, which are made entirely from synthetic plastics material, there are grooves 9 provided on their upper surface faring towards the rail 6 for the purpose of keeping them free from contamination. These grooves are disposed at an acute angle in relation to the longitudinal axis of the slide insert, so that any contaminants which may possibly accumulate may easily be carried away through said grooves. Furthermore, in a shared slide base 4, there may be two slide inserts 5 disposed parallel to one another and held in position with the use of one locking-in member 7 in common.

In the embodiment according to FIGS. 2 to 4, use is made of a modified design of a maintenance-free slide insert 10. This slide insert consists of a base material which incorporates stations 11 for a lubricant. For the sake of rarity, the lubricant stations 11 are not depicted in FIGS. 3 to 4. It may be seen dearly that the slide insert 10 has a groove 12 on its underside, disposed transversely to its longitudinal axis, which, in the correct position of the slide insert in the slide base or ribbed plate comes into alignment with a similar elongate groove in the slide base or ribbed plate, as may be seen dearly in the subsequent Figures.

The slide insert 10 possesses one continuous sloping surface 13 on its longitudinal sides, whereas the surfaces on its opposite side are discontinuous, giving rise to projections 14 which are separated from each other by completely offset regions 15. In this manner, after the fashion of a bayonet connection, it is possible to introduce a slide insert into a correspondingly shaped recess in the slide base or ribbed plate, as may be seen dearly by referring to FIGS. 5 to 7, so that the overall result is to make shorter displacement pathways available for securing the slide inserts in position where they are prevented from springing out.

In FIGS. 5 to 7, an appropriately shaped slide base or ribbed plate 16 is depicted, suitable for use in conjunction with the slide inserts in accordance with FIGS. 2 to 4. The groove 18 disposed transversely to its longitudinal axis indicated by 17 is clearly visible and, in the inserted position of the slide insert 10, it comes into alignment with the groove 12 in the underside of the slide insert and provides a free passage for insertion of a rod-shaped locking-in member, as may be seen in FIG. 1, for example. The recess 19 in the slide base or ribbed plate for accommodating the slide inserts 10 possesses a continuous inwardly-sloping surface on one side wall, whereas the surface, on the opposite side wall of the recess, in concordance with the projecting or offset regions 14 and 15 of the slide insert 10, is configured with discontinuous inwardly-directed wall regions 21 separated from one another by un-occupied regions 22, so that a secure fixing in position of the slide inserts 10 is ensured by the bayonet connection.

The representation of a modified embodiment in FIGS. 8 to 10 is similar to that in FIGS. 5 to 7, in which case the slide inserts 10 are depicted partly in the fully inserted position and partly in a pivoted out position from which it may be pushed further into position. It may be seen, especially from FIG. 8, that the slide insert 10 on the left-hand side with the projecting regions 14 on the side wall may be pushed down into the free regions 22 in the region of the side walls 21, whereupon, after a displacement of the slide insert 10 in the direction of its longitudinal axis, the gripping of the side wall regions of the slide insert 10 will be ensured. After the complete insertion of the second slide insert, a rod-shaped locking-in member 7 can be inserted in the free passage defined by the aligned grooves 12 and 18 and its free ends may be bent around the outer edges of the slide base. In the case of the embodiment in accordance with FIGS. 8 to 10, the slide base or fibbed plate possesses contact stop regions 23 for limitation of the pushing-in movement of the slide inserts 10, in which case the slide inserts are likewise gripped by the inwardly-sloping side walls.

In FIGS. 11 and 12 there is depicted, in plan view and side elevation, an embodiment in accordance with FIGS. 8 to 10 suitable for the insertion of a slide insert 10, in which case the continuous outwardly-sloping side walls of the slide insert, corresponding to the recess 19 in the slide base or ribbed plate, project out over a greater region than that depicted in FIG. 2.

I claim:

1. A device for fastening at least one exchangeable slide insert, formed of synthetic plastic material, in an elongated recess within a slide base, said slide insert having surfaces on opposite sides thereof which extend longitudinally of the slide insert and which are received within respective undercut walls on opposite sides of the recess; a first groove formed in an underside surface of said slide insert facing the slide base along a bottom surface of the recess, said groove extending transversely of the slide insert; a second groove formed in said bottom surface and extending transversely of the slide base; and a locking member located within said first and second grooves when the slide insert is positioned relative to the slide base such that the grooves are in alignment, said locking member having plastically deformable free ends which project beyond the slide base.

2. A device according to claim 1, wherein the locking member is formed from a flat bar.

3. A device according to claim 2, wherein the flat bar has a rectangular cross-section.

4. A device according to claim 1 or 2, wherein the slide insert has a length substantially equal to that of the slide base.

5. A device according to claim 1 or 2, wherein said slide insert, on a surface on the opposite side thereof from said underside surface, is provided with a plurality of grooves which extend at an acute angle relative to a longitudinal axis of the slide insert.

6. A device according to claim 1 or 2, wherein said slide base is provided with a plurality of recesses, each receiving a respective slide insert, said locking member securing each of said slide inserts against movement in a longitudinal direction relative to the slide base.

* * * * *